United States Patent [19]

Lee

[11] Patent Number: 4,714,446

[45] Date of Patent: Dec. 22, 1987

[54] TOY FIGURE WITH EXPANDABLE LATCH

[75] Inventor: Sam Y. Lee, Los Angeles, Calif.

[73] Assignee: Mattel, Inc., Hawthorne, Calif.

[21] Appl. No.: 908,127

[22] Filed: Sep. 16, 1986

[51] Int. Cl.[4] ..... A63H 11/06

[52] U.S. Cl. ..... 446/311; 446/361; 446/353

[58] Field of Search ..... 446/311, 309, 308, 321, 446/4, 97, 99, 268, 330, 334, 353, 361, 359, 486, 491

[56] References Cited

U.S. PATENT DOCUMENTS 1,277,702 9/1918 Des Combes ..... 446/4 X
4,186,518 2/1980 Luke ..... 446/268 X

FOREIGN PATENT DOCUMENTS 987553 8/1951 France ..... 446/309

OTHER PUBLICATIONS

"Slinky Popup", Playthings, vol. 56, No. 3, Mar. 1958, p. 308.

*Primary Examiner*—Mickey Yu
*Attorney, Agent, or Firm*—Ronald M. Goldman; Melvin A. Klein; Daniel F. Sullivan

[57] ABSTRACT

A toy figure having two torso halves releasably held together by a pair of engaging lips attached to an expandable latch. A cable may be easily inserted into an aperture in the back of the toy figure. A child may then press a cable button which forces an actuator to engage a tab attached to the latch, causing the latch to move or expand. As the latch expands, the engaging lips disengage allowing the torso halves to separate under the force of a compressed spring mounted inside one of the torso halves. As the torso halves separate, the toy figure appears to split in half.

5 Claims, 6 Drawing Figures

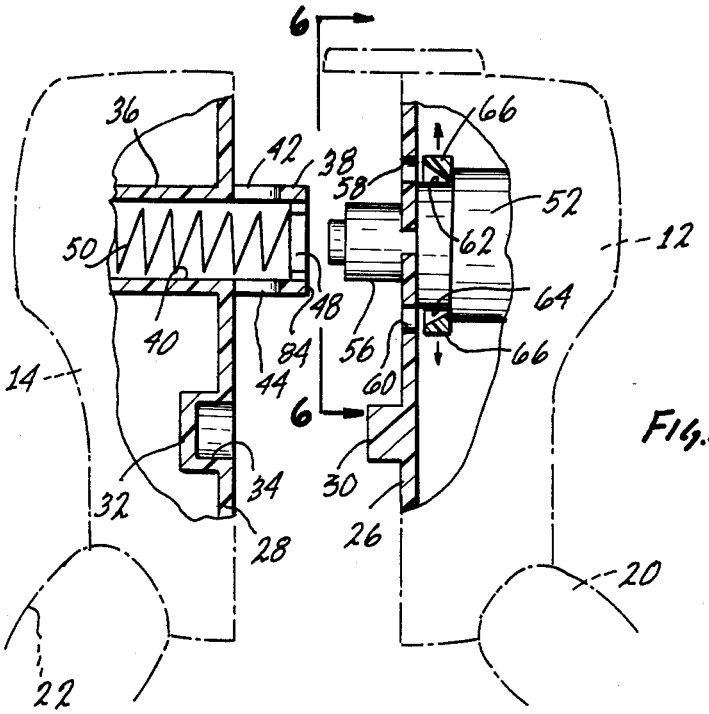
FIG. 5
FIG. 6
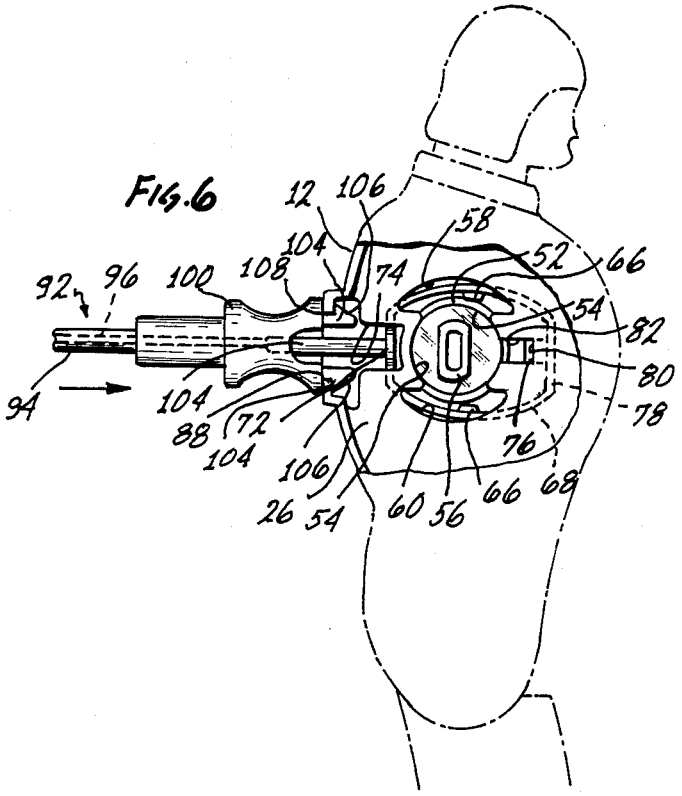

TOY FIGURE WITH EXPANDABLE LATCH

BACKGROUND OF THE INVENTION

The present invention relates generally to toy figures and, more particularly, to a toy figure having two torso halves releasably held together by an expandable latch which may be activated by a cable in order to release the latch and allow a spring to force the halves apart so that the toy appears to split in half.

In the past, a variety of toy grenades and other simulated detonating toys have been fabricated. Such toys are disclosed in U.S. Pat. No. 4,319,426 issued to Lee on Mar. 16, 1982; U.S. Pat. No. 3,878,639 issued to Scheelar, et al on Apr. 22, 1975; U.S. Pat. No. 3,564,756 issued to Yokoi on Feb. 23, 1971; U.S. Pat. No. 3,304,650 issued to Glass, et al on Feb. 21, 1967; U.S. Pat. No. 3,139,697 issued to Mier on July 7, 1964; U.S. Pat. No. 3,029,556 issued to Ayala on Apr. 17, 1962; U.S. Pat. No. 2,897,630 issued to Horowitz, et al on Aug. 4, 1959; U.S. Pat. No. 1,536,261 issued to Eames on May 5, 1925; and U.S. Pat. No. 1,367,391 issued to Hofer on Feb. 1, 1921. Toy boats having parts which fly apart or separate upon activation of a mechanism are described in U.S. Pat. No. 2,052,841 issued to O'Donnell on Sept. 1, 1936; U.S. Pat. No. 1,859,100 issued to Lewis on May 17, 1932; and U.S. Pat. No. 1,300,177 issued to Kohn on April 8, 1919. Other toys having parts which separate or come apart upon activation of an impact responsive mechanism are shown in U.S. Pat. No. 4,571,197 issued to Kulesza, et al on Feb. 18, 1986; U.S. Pat. No. 3,734,500 issued to Cooper on May 22, 1973; U.S. Pat. No. 3,687,452 issued to Thompson on Aug. 29, 1972; and U.S. Pat. No. 3,235,259 issued to Glass, et al on Feb. 15, 1966.

Different toy figures having detachable parts or appendages which may be removed and replaced or discharged from the toys as projectiles are disclosed in U.S. Pat. No. 4,185,412 issued to Rahmstorf on Jan. 29, 1980; U.S. Pat. No. 4,136,481 issued to Nicholls on Jan. 30, 1979; U.S. Pat. No. 4,125,961 issued to Yamashina on Nov. 21, 1978; and U.S. Pat. No. 4,118,888 issued to Ogawa on Oct. 10, 1978. Finally, toy figures having fingeractuated mechanisms are shown in U.S. Pat. No. 4,569,666 issued to Wolf on Feb. 11, 1986; U.S. Pat. No. 4,126,961 issued to Barlow, et al on Nov. 28, 1978; and U.S. Pat. No. 3,928,934 issued to Lewis, et al on Dec. 30, 1975.

None of the above patents discloses a toy figure having two torso halves releasably held together by an expandable latch which a child may activate by pressing a cable button with his or her thumb in order to release the latch and allow a spring to force the torso halves apart A particularly dramatic effect is presented as the torso halves separate since the figure toy appears to split in half. Additional play options are presented if the cable is removable allowing a child to play with the toy figure without the cable attached. Accordingly, there is a need in the toy manufacturing arts for a toy figure having two torso halves releasably held together by an expendable latch which may be activated by a removable cable in order to allow the torso halves to separate so that the toy appears to split in half.

SUMMARY OF THE INVENTION

It is an object of the invention to provide a toy figure having two torso halves releasably held together by an expandable latch which a child may activate by pressing a cable button in order to release the latch and allow a spring to force the torso halves apart.

It is another object of this invention to provide a toy figure having a removable cable used to activate an expandable latch in order to separate two torso halves of the toy figure.

These and other objects and advantages are attained by a toy figure having two torso halves releasably held together by a pair of engaging lips attached to an expandable latch. A cable may be easily inserted into an aperture in the back of the toy figure. A child may then press a cable button which forces an actuator to engage a tab attached to the latch, causing the latch to move or expand. As the latch expands, the engaging lips disengage allowing the torso halves to separate under the force of a compressed spring mounted inside one of the torso halves. As the torso halves separate, the toy figure appears to split in half.

The various features of the present invention will be best understood together with further objects and advantages by reference to the following description of the preferred embodiment taken in connection with the accompanying drawings.

BRIEF DESCRIPTION OF THE DRAWINGS

FIG. 5 is a partial front elevational view of the toy figure of FIG. 1 with portions of the toy represented by dashed lines and broken away showing the torso halves separated; and FIG. 6 is a partial side elevational view taken in the direction of arrows 6—6 of FIG. 5 with portions of the toy figure represented by dashed lines and broken away showing how a cable actuator may be pushed forward in order to move a pair of engaging lips of the expandable latch.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that various modifications can be accomplished within the parameters of the present invention.

Figure 1:
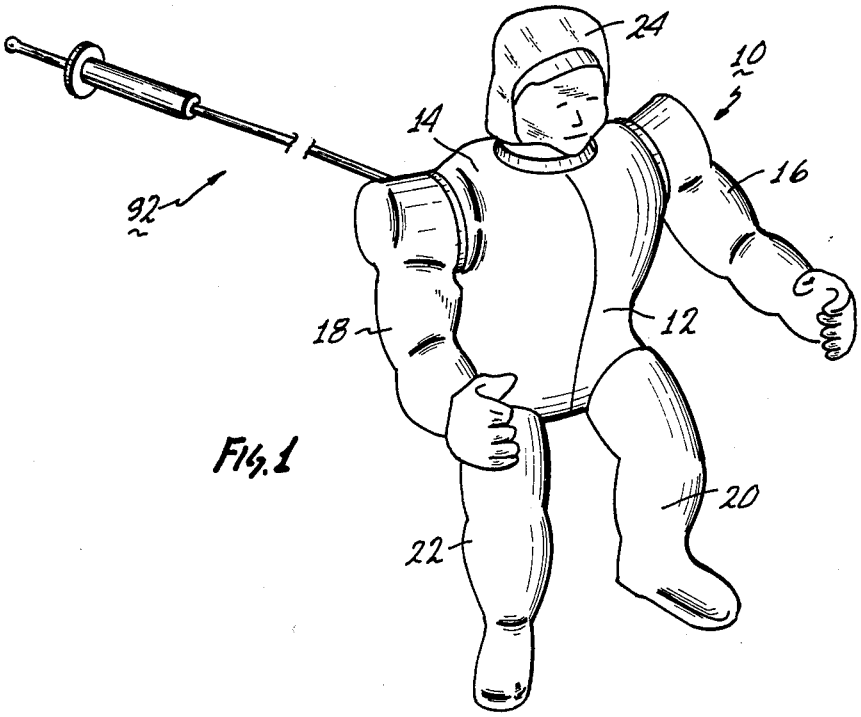
FIG. 1 is a perspective view of the preferred embodiment of the toy figure of the present invention.
Figure 2:
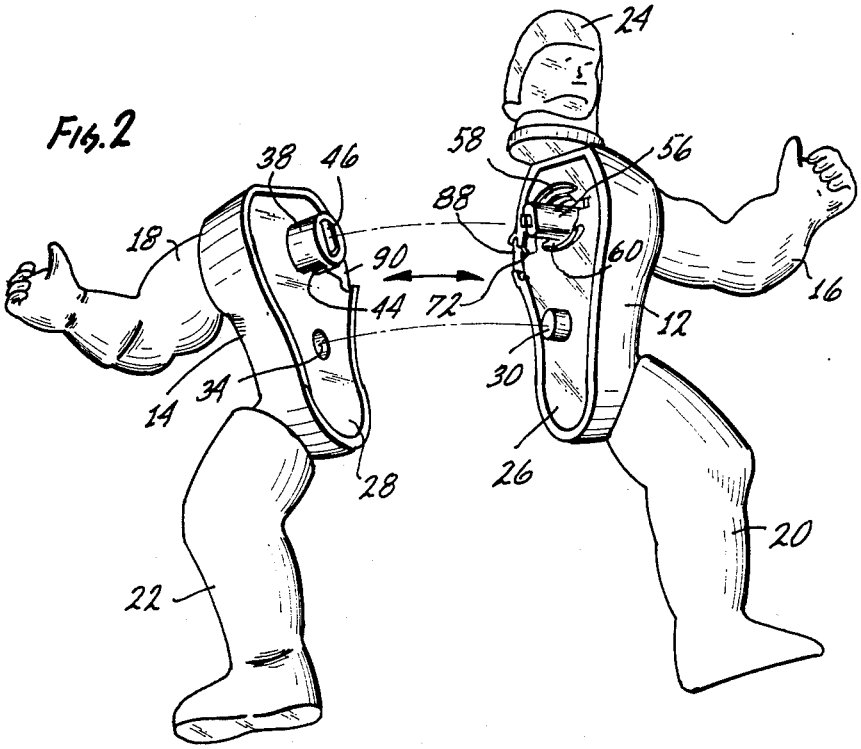
FIG. 2 is a perspective view of the toy figure of FIG. 1 showing two torso halves of the toy separated.

Referring now to the drawings and particularly the FIGS. 1 and 2, a preferred embodiment of the toy FIG. 10 of the present invention is disclosed. The toy FIG. 10 has hollow torso halves or portions 12 and 14. Articulated arms 16 and 18 are coupled to the torso halves 12 and 14, respectively. Similarly, articulated legs 20 and 22 are coupled to torso halves, 12 and 14, respectively. Other types of limbs or appendages may be coupled to the torso halves 12 and 14 if desired. A head 24 is shown attached to torso half 12. However, the head may be attached to either of the torso halves 12 and 14.

Figure 3:
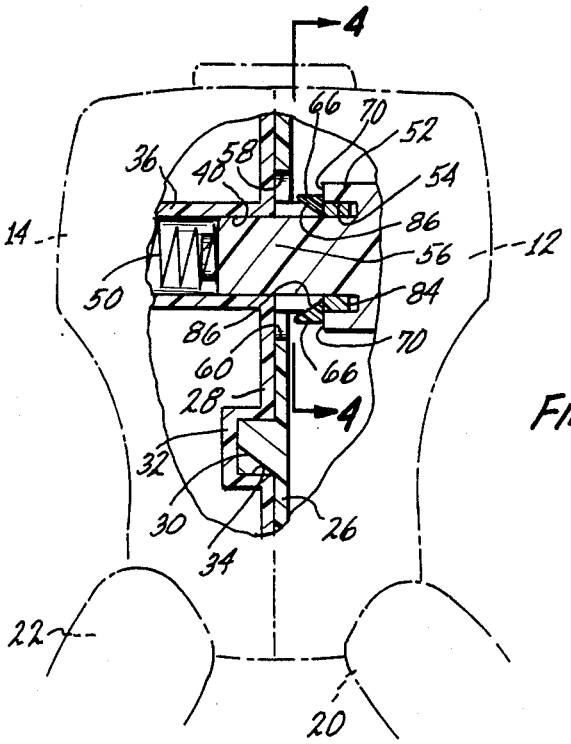
FIG. 3 is a partial front elevational view of the toy figure of FIG. 1 with portions of the toy represented by dashed lines and broken away to show how an expandable latch releasably holds the torso halves together.

The torso halves 12 and 14 have inner covers 26 and 28, respectively, attached thereto as shown in FIGS. 2, 3 and 5. Cover 26 has a generally cylindrically-shaped portion 30 extending outwardly therefrom. As best shown in FIGS. 3 and 5, cover 28 has a first generally cylindrically-shaped portion 32 extending inside torso half 14 forming cylindrical bore 34. Cover 28 has a second generally cylindrically-shaped portion 36 extending inside torso half 14 and a generally cylindrically-shaped portion 38 extending outwardly therefrom. The inside surfaces of portions 36 and 38 form cylindrical bore 40. As best shown in FIGS. 2 and 5, slots 42 and 44 pass through portion 38. Aperture 46 (see FIG. 2) passes through end wall 48 (see FIG. 5) of portion 38. A spring 50 is trapped inside bore 40. One end of spring 50 is biased against end wall 48 while its other end is biased against an end wall (not shown) of portion 36 inside torso half 14 as desired.

Figure 4:
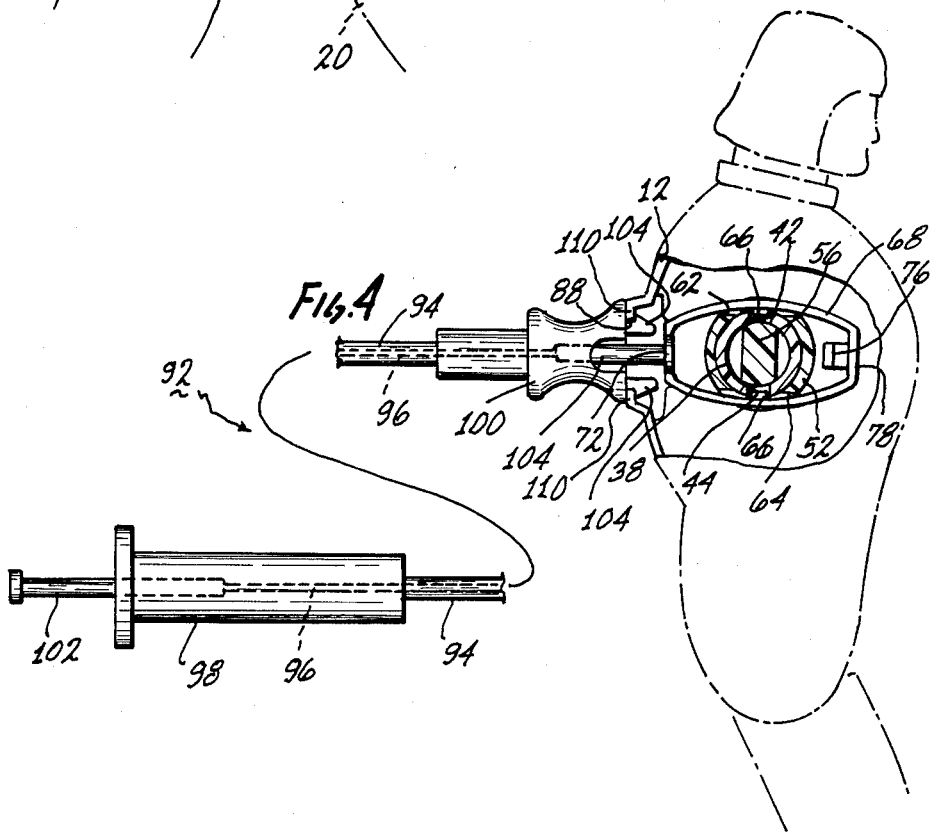
FIG. 4 is a partial side elevational view taken in the direction of arrows 4—4 of FIG. 3 with portions of the toy figure represented by dashed lines and broken away to show how a cable assembly releasably engages the toy.

A generally cylindrically-shaped portion 52 (see FIGS. 3 and 5) extends from cover 26 inside torso half 12. Portion 52 has a longitudinal cylindrical bore 54. Extending from the bottom of bore 54 past cover 26 is an extension 56. Two apertures 58 and 60 pass through cover 26. As best seen in FIGS. 4 and 5, slots 62 and 64 pass through portion 52 in order to provide room for two engaging lips 66 of an expandable latch 68.

Lips 66 of latch 68 engage slots 62 and 64 between cover 26 and edges 70 of the slots (see FIG. 3) and are free to slide or move within the slots toward or away from extension 56 due to the flexibility of latch 68 which is preferably fabricated using a relatively thin and flexible material. An engaging tab 72 is attached to one end of the expandable latch 68. Tab 72 is free to move or slide within slot 74 (see FIG. 6) in cover 26. Another tab 76 is attached to the other end 78 of latch 68. End 78 of the latch 68 is prevented from moving. This may be accomplished by any desirably method such as restricting movement of end 78 by a stop or other member attached to the cover 26 or torso half 12, using edge 80 of slot 82 in cover 26 to restrict movement of tab 76 as shown in FIG. 6, or the like.

Torso halves 12 and 14 may be releasably fit together by pushing portion 30 into bore 34 and extension 56 into bore 40 causing the spring 50 to compress as shown in FIG. 3. As extension 56 engages bore 40, end 84 of portion 38 comes into contact with slanted edges 86 (see FIG. 3) of the engaging lips 66 causing lips 66 to move away from extension 56 due to the flexibility of latch 68. After end 84 moves past edges 86, lips 66 will then engage slots 42 in portion 38 as shown in FIGS. 3 and 4 holding the two torso halves 12 and 14 together.

Generally U-shaped slots 88 and 90 (see FIG. 2) are formed at the back of torso halves 12 and 14, respectively, so that the slots form an aperture when the torso halves are fit together. A cable 92 releasably engages the aperture formed by slots 88 and 90 as shown in FIGS. 4 and 6. The cable 92 has an outer cable body 94 preferably fabricated from a soft, flexible material such as polyvinyl chloride, or the like. An inner cable 96 is located inside and slidably engages cable body 94. Inner cable 96 is preferably molded out of nylon or some other material that is flexible and durable. Attached to opposite ends of the outer cable body 94 are a pushbutton holder 98 and cable attaching device 100. A pushbutton 102 is attached to one end of inner cable 96. Both the pushbutton 102 and cable 96 slidably engage holder 98. An actuator 104 is attached to the other end of cable 96. The actuator 104 and cable 96 are free to move or slide within device 100.

A pair of flexible portions 104 with slanted edges 106 and lips 108 (see FIG. 6) are connected to the cable attaching device 100. The cable 92 may be releasably coupled to the back side of the toy figure 10 by pushing the flexible portions 104 into the aperture formed by slots 88 and 90. This is easily accomplished since portions 104 will bend when slanted edges 106 come into contact with flanges 110 (see FIG. 4) existing at both slots 88 and 90. After the slanted edges 106 are pushed past the flanges 110, lips 108 will engage the flanges as shown in FIGS. 4 and 6, releasably holding the cable 92 to the toy FIG. 10.

The cable 92 may be used with the toy figure 10 by first fitting the torso halves 12 and 14 together as shown in FIG. 3, and then pushing the flexible portions 106 into the aperture formed by slots 88 and 90. A child may then grasp holder 98 and push pushbutton 102 with his or her thumb forcing the inner cable 96 forward and the actuator 104 inside the toy FIG. 10 until it comes into contact with tab 72 of the expandable latch 68 as shown in FIG. 4. If the child continues to push the pushbutton 102, then the latch 68 will move or expand in the direction of the arrows shown in FIGS. 5 and 6 since end 78 cannot move. As the latch 68 expands, engaging lips 66 will disengage or move out of slots 42 and 44 in portion 38. After the lips 66 disengage, the compressed spring 50 will force extension 56 out of cylindrical bore 40, disengaging extension 56 from portion 38. As extension 56 and portion 38 are disengaged by spring 50, the toy FIG. 10 appears to be splitting apart as torso halves 12 and 14 separate and the cable 92 disengages from the toy FIG. 10. Preferably, the cable 92 has a spring (not shown) mounted within holder 98 which returns the pushbutton 102 to its original position.

A child may use the toy FIG. 10 without the cable 92 by simply fitting the torso halves 12 and 14 together and playing with the figure like any other action figure. In such a case, the engaging lips 66 will securely hold the torso halves 12 and 14 together.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention. For example, the toy 10 may have any configuration and may have more, less or different types of arms, legs or appendages.

I claim:

1. A toy figure comprising:

a first torso half;

a second torso half releasably coupled to said first torso half;

expandable latch means for releasably holding said first and second torso halves together;

spring means within one of said first and second torso halves for biasing said torso halves apart; and cable means releasably coupled to said first and second torso halves for expanding said expandable latch means in order to allow said spring means to separate said torso halves.

2. The toy figure of claim 1 wherein said first torso half has a generally cylindrically-shaped portion attached thereto with slots therein and said second torso half has an extension attached thereto, said extension capable of engaging a cylindrical bore in said generally cylindrically-shaped portion.

3. The toy figure of claim 2 wherein said expandable latch means is mounted within said second torso half and includes engaging lips attached thereto capable of releasably engaging said slots in said generally cylindrically-shaped portion.

4. The toy figure of claim 3 wherein said spring means is located within said cylindrical bore of said generally cylindrically-shaped portion.

5. A toy figure comprising:

a first hollow torso half having (a) a cover attached thereto, (b) a first generally cylindrically-shaped portion attached to said cover and extending inside said first torso half and (c) a second generally cylindriclly-shaped portion attached to said cover and extending outwardly therefrom, said second portion having slots therein;

a second hollow torso half having (a) a cover attached thereto, (b) a third generally cylindrically-shaped portion attached to said cover attached to said second torso half and extending inside said second torso half and (c) an extension extending from the bottom of a cylindrical bore in said third generally cylindrically-shaped portion;

a spring located within a cylindrical bore passing longitudinally through said first and second generally cylindrically-shaped portions;

expandable latch means located within said second torso half for releasably holding said first and second torso halves together, said expandable latch means includes engaging lips capable of releasably engaging said slots in said second generally cylindrically-shaped portion; and cable means releasably coupled to said first and second torso halves for expanding said expandable latch means in order to allow said spring to separate said torso halves.

* * * * *